US012709313B2

(12) United States Patent
French et al.

(10) Patent No.: US 12,709,313 B2
(45) Date of Patent: Aug. 18, 2026

(54) RAIL BOND MONITOR

(71) Applicant: Modern Railway Systems, Inc., Alameda, CA (US)

(72) Inventors: Roger French, St. Augustine, FL (US); JEffrey Randall Koval, Lee's Summit, MO (US)

(73) Assignee: Modular Railway Systems, Alameda, CA (US)

( * ) Notice: Subject to any disclaimer, the term of this patent is extended or adjusted under 35 U.S.C. 154(b) by 433 days.

(21) Appl. No.: 18/531,412

(22) Filed: Dec. 6, 2023

(65) Prior Publication Data

US 2024/0217566 A1 Jul. 4, 2024

Related U.S. Application Data

(60) Provisional application No. 63/436,378, filed on Dec. 30, 2022.

(51) Int. Cl.

| | |
|---|---|
| ***B61K 9/08*** | (2006.01) |
| ***B61L 1/18*** | (2006.01) |
| ***B61L 1/20*** | (2006.01) |
| ***B61L 25/06*** | (2006.01) |

(52) U.S. Cl.

CPC ..... *B61K 9/08* (2013.01); *B61L 1/181* (2013.01); *B61L 1/187* (2013.01); *B61L 1/20* (2013.01); *B61L 25/065* (2013.01)

(58) Field of Classification Search

CPC . B61K 9/08; B61L 1/181; B61L 1/187; B61L 1/20; B61L 23/042; B61L 23/044; B61L 25/065; B61L 3/222

USPC ..... 246/37

See application file for complete search history.

(56) References Cited

U.S. PATENT DOCUMENTS

2010/0025545 A1* 2/2010 Koval ..... B61L 1/187 246/107
2018/0339718 A1* 11/2018 Hogan ..... B61L 1/188

FOREIGN PATENT DOCUMENTS

KR 101957146 B1 * 3/2019 ..... G01R 23/20
KR 102060122 B1 * 12/2019 ..... G01R 31/005
KR 20200039514 A * 4/2020 ..... G01R 19/16571

OTHER PUBLICATIONS

Machine translation (Year: 2026).*

* cited by examiner

*Primary Examiner* — Zachary L Kuhfuss
(74) *Attorney, Agent, or Firm* — Rutan and Tucker, LLP

(57) ABSTRACT

The rail bond monitor has a frequency transmitter to generate an electronic signal at a known energy level to pass through two or more impedance bonds located at an insulated rail junction between two sections of railroad tracks in order to allow a change in energy level, under analysis, at a receiver to be detected from an expected amount of energy level. An energy level detector is coupled to the receiver to detect the energy level under analysis at the receiver and compare that to the expected amount of energy level, and then generate a notice signal configured to trigger a relay output when the change in energy level under analysis is beyond a threshold amount. The relay output sends an output into a rail controller to warn that a problem exists with the impedance bonds themselves and/or the electrical paths between the railroad tracks and the impedance bonds, at a given insulated rail junction.

20 Claims, 10 Drawing Sheets

RAIL BOND MONITOR

RELATED APPLICATIONS

This application claims priority under 35 USC 119 to U.S. provisional patent application Ser. 63/436,378, titled "Rail Bond Monitor," filed 30 Dec. 2022, which the disclosure of such is incorporated herein by reference in its entirety.

FIELD

Embodiments generally relate to a rail track system. More particularly, an aspect of an embodiment relates to a Rail Bond Monitoring system.

SUMMARY

Provided herein are some embodiments. In an embodiment, the design is directed to rail bond monitoring system.

The rail bond monitor is produced and/or manufactured with an overlay track circuit that has at least one frequency transmitter to generate an electronic signal at a known energy level to pass through two or more impedance bonds located at an insulated rail junction between two sections of railroad tracks in order to allow a change in energy level under analysis at least one receiver to be detected from an expected amount of energy level. An energy level detector is coupled to the receiver to detect the energy level under analysis at the receiver and compare that to the expected amount of energy level, and then generate a notice signal configured to trigger a relay output when the change in energy level under analysis is beyond a threshold amount.

Multiple electrical leads are configured to affix to the track leads in a railroad and/or transit track circuit. A first set of electrical leads, which are connected to the frequency transmitter, are configured to connect to a first impedance bond located at the insulated rail junction between the two sections of the railroad track. A second set of electrical leads, which are connected to the receiver, are configured to connect to a second impedance bond located on an opposite side of the insulated rail junction than the first impedance bond.

The relay output is coupled to the energy level detector and has one or more output leads that go into one or more inputs of an existing rail controller to act as a warning that a problem exists with at least one of i) an electrical condition at the impedance bonds themselves as well as an electrical condition of electrical paths between the railroad tracks and the impedance bonds, at a given insulated rail junction. The relay output is configured to change when the detected change in the energy level under analysis is beyond the threshold amount. Thus, the rail bond monitor is configured to provide a warning system, through detected change in the energy level, that the problem exists with at least one of i) an electrical condition at the impedance bonds themselves as well as ii) an electrical condition of electrical paths between the railroad tracks and the impedance bonds, at the given insulated rail junction.

These and other features of the design provided herein can be better understood with reference to the drawings, description, and claims, all of which form the disclosure of this patent application.

BRIEF DESCRIPTION OF THE DRAWINGS

The multiple drawings refer to the example embodiments of the design.

Figure 1:
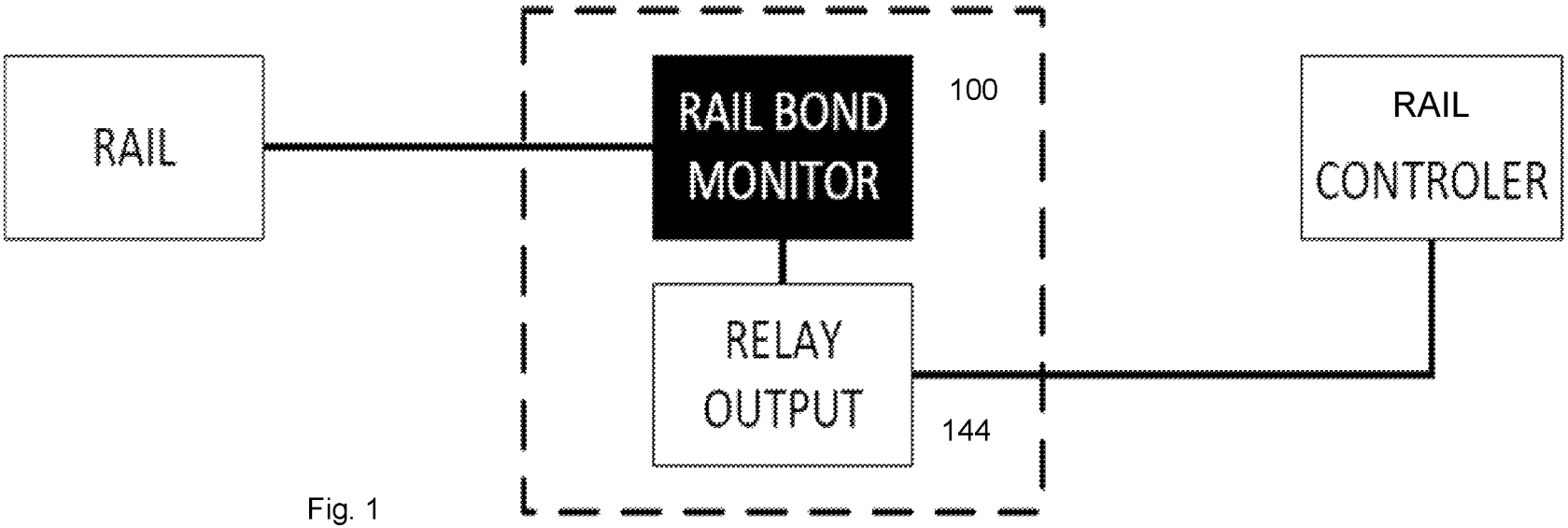
FIG. 1 illustrates a block diagram of an embodiment of an example rail bond monitor with a relay output that goes to a controller, such as a wayside controller, implemented in the railroad track circuit for the rails of the railroad system.

While the design is subject to various modifications and alternative forms, specific embodiments thereof have been shown by way of example in the drawings and will herein be described in detail. The design should be understood to not be limited to the particular forms disclosed, but on the contrary, the intention is to cover all modifications, equivalents, and alternatives falling within the spirit and scope of the design.

DETAILED DISCUSSION

In the following description, numerous specific details are set forth, such as examples of specific data signals, named components, number of leads go to a device, etc., in order to provide a thorough understanding of the present design. It will be apparent, however, to one of ordinary skill in the art that the present design can be practiced without these specific details. In other instances, well known components or methods have not been described in detail but rather in a block diagram in order to avoid unnecessarily obscuring the present design. Thus, the specific details set forth are merely exemplary. Also, the features implemented in one embodiment may be implemented in another embodiment where logically possible. The specific details can be varied from and still be contemplated to be within the spirit and scope of the present design. The term coupled is defined as meaning connected either directly to the component or indirectly to the component through another component.

Example embodiments of the rail bond monitor will be discussed below. Note, when a railroad is being discussed below that includes a traditional railroad as well as other forms of transit systems using tracks. Also, when a train is discussed that includes varies forms of locomotives including trains, trams, etc.

FIG. 1 illustrates a block diagram of an embodiment of an example rail bond monitor with a relay output that goes to a controller, implemented in the railroad track circuit for the rails of the railroad system.

The drawings illustrate aspects of a rail bond monitor 100 that is produced and/or manufactured with components such as tuned filter circuits, such as inductive-capacitance circuits/couplers to act as a bandpass filter and software defined filtering, an audio frequency overlay track circuit 110 with a relay drive output that changes when the change in energy level (e.g., impedance) is detected, etc.

The audio frequency overlay track circuit 110 has at least one frequency transmitter to generate an electronic signal at a known energy level to pass through two or more impedance bonds (e.g., Z bonds) located at an insulated rail junction between two sections of railroad tracks in order to allow a change in energy level (e.g., impedance), under analysis, at a receiver to be detected from an expected amount of energy level. The energy level detector 122 (e.g., electronic circuit and/or other logic) coupled to the receiver detects the energy level under analysis at the receiver and compares that to the expected amount of energy level, and then generates a notice signal configured to trigger a relay output 144 when the change in energy level under analysis is beyond a threshold amount.

Multiple electrical leads 133 come from a housing of the rail bond monitor 100. The electrical leads 133 affix (e.g., clip) to track leads or another connection mechanism to the track leads in a railroad track circuit. A first set of electrical leads 133, which are connected to the frequency transmitter, are configured to connect to a first impedance bond located at the insulated rail junction between the two sections of the railroad track. A second set of electrical leads 133, which are connected to the receiver, are configured to connect to a second impedance bond located on an opposite side of the insulated rail junction than the first impedance bond. The relay output 144 (which can be an actual relay or another electronic circuit that switches between two or more steady state electrical voltage conditions) is coupled to the energy level detector 122. The relay output 144 has one or more output leads that go into one or more inputs of a rail controller (such as a PLC) to act as a warning that a problem exists with at least one of i) an electrical condition at the impedance bonds themselves as well as ii) an electrical condition of electrical paths between the railroad tracks and the impedance bonds, at a given insulated rail junction. The output leads of the relay output 144 are configured to change when the detected change in the energy level (e.g., impedance) under analysis is beyond the threshold amount. Thus, the rail bond monitor 100 is configured to provide a warning system, through detected change in the energy level, that the problem exists with at least one of i) an electrical condition at the impedance bonds themselves as well as ii) an electrical condition of electrical paths between the railroad tracks and the impedance bonds, at the given insulated rail junction. A battery or other power source is connected to the overlay track circuit 110, the energy level detector 122, and the relay output 144.

The example rail monitoring PLC (e.g., wayside controller) has microprocessors or signaling processors that have standard inputs and outputs. The rail bond monitor 100 allows remote monitoring of rail bond status and impedance bond of electrical paths at the impedance bonds at an insulated rail junction between two sections of the railroad track.

Overall, a railway electrification system supplies electric power to railway trains. The electrical track propulsion circuit/railroad propulsion system supplies power to moving trains with a (nearly) continuous conductor running along the track that usually takes one of two forms: an overhead line, suspended from poles or towers along the track or from structure or tunnel ceilings, or a third rail mounted at track level and contacted by a sliding "pickup shoe". With the electrification/electrical propulsion circuit, the rail now becomes part of the electrical circuit and electrifying electric tracks. Both the overhead wire and third-rail systems usually use the running rails as the electrical return conductor.

In addition, a basic track circuit/railroad signaling system is used in the rails for detecting trains. The track circuit uses the electrical characteristics of the railroad track to perform train/locomotive detection with its track circuit. Each section of track in a track circuit is separated from its neighboring sections by an insulated joint installed in one or both of the running rails. The two rails can be referred to as the Signal Rail and the Neutral/Return Rail. Note, an example two parallel track circuit and implementation will mainly be discussed. See, for example, FIG. 3. However, multiple rail/track configurations can also be implemented, for example, four parallel railroad tracks. See, for example, FIG. 6.

Railway tracks can be divided into circuits of varying lengths. Each circuit stands out from the adjacent ones by means of an insulated joint between rails and it permits the detection of the presence of a shunt; and thus, potentially a train. In general, the presence of a train is detected by the electrical connection between the rails, provided by the wheels and the axles of the train (wheel-to-rail shunting). However, this is not the only function that track circuits perform in a railway signaling system because the detection information is used also to control train speed and ensure safe operation, etc., by using different transmission commands to and from the wayside controller. The rail bond monitor 100 can take advantage of many existing connections in the railroad signaling system in order to give an insight into the condition of electrical return paths, through the impedance bonds, used in the railroad electrical propulsion system discussed above.

On either side of the insulated rail joint is an impedance bond. For example, see FIG. 3 where the insulated rail joint is those two vertical lines between the two impedance bonds. The impedance bond separates trained detection zones and track circuits. Each impedance bond can be an electrical component made, with an inductive coil, to be low resistance and relatively high reactance. The purpose of the impedance bonds on each side of the insulated rail junction is to provide continuity between the track circuits for the DC propulsion power and to distribute the propulsion current between the two running rails. The impedance bonds do this while still maintaining a relatively high impedance at the signaling frequencies between the two rails and between adjacent track circuits. The impedance bond has special characteristics of the inductance and the windings, such that the impedance bond provides a low impedance to propulsion electrical current, but a high impedance to the signaling from the track circuits, so the system can still maintain train detection, but also provide an electrical return path for electrical current. Note, a rail bond can be an electric jumper, usually made of brass or copper, around a joint in the rails of a track and/or to the impedance bonds themselves to ensure continuity of electrical conductivity.

Figure 2:
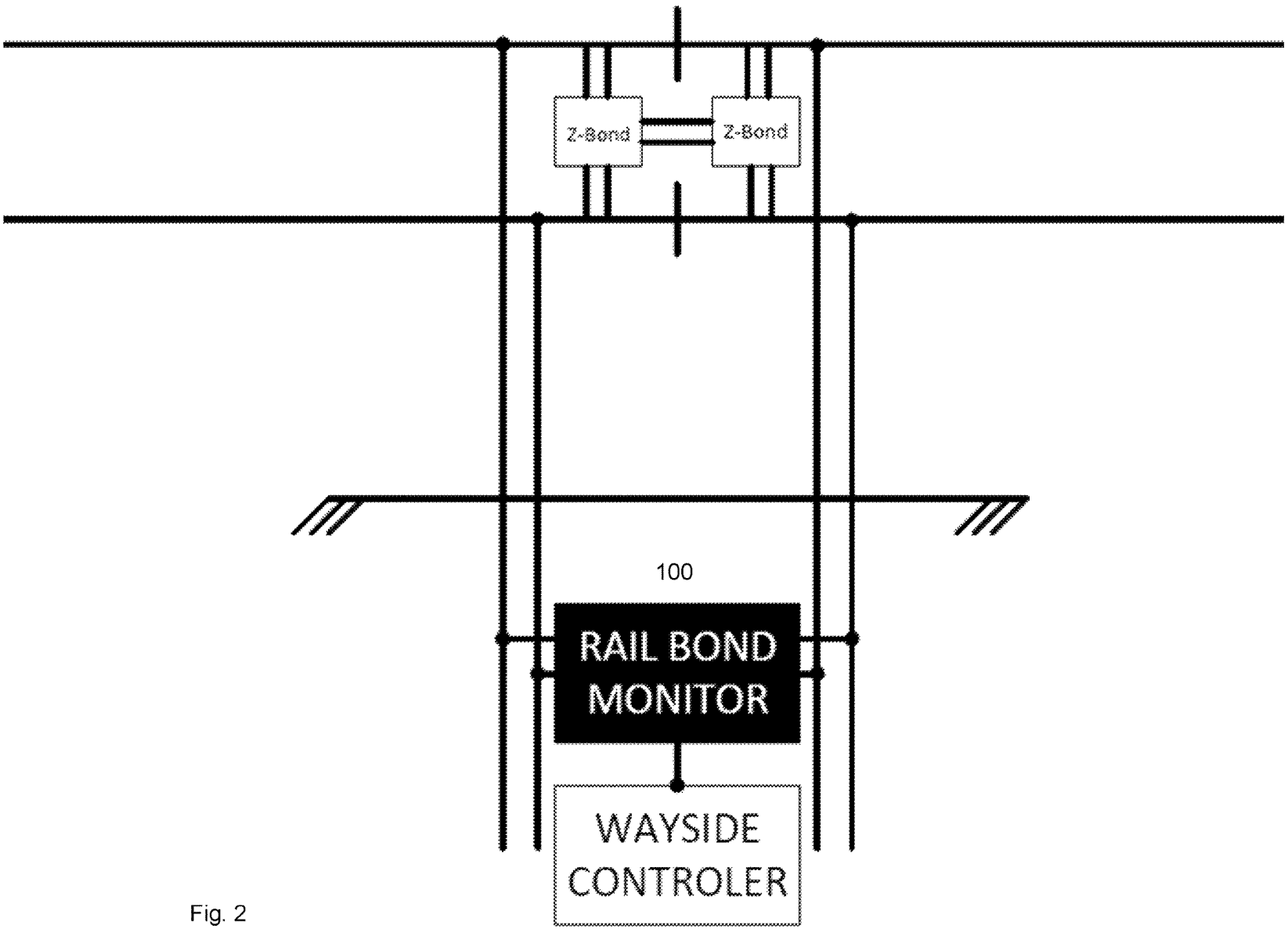
FIG. 2 illustrates a system diagram of an embodiment of an example rail bond monitor with a little more detail compared to FIG. 1.

FIG. 2 illustrates a system diagram of an embodiment of an example rail bond monitor with a little more detail compared to FIG. 1. The rail bond monitor 100 connects to both the impedance bond and track propulsion circuit as well as the rail controller.

As discussed, each section of track in a track circuit is separated from its neighboring sections by an insulated joint installed in one or both of the running rails. Also, on either side of the insulated rail joint is an impedance bond (e.g., Z-bond). The insulated rail joint is those two vertical lines between the two Z bonds and at a 90-degree angle to the railroad tracks themselves. The impedance bond provides an electrical return path for electrical current for that propulsion track system.

Figure 3:
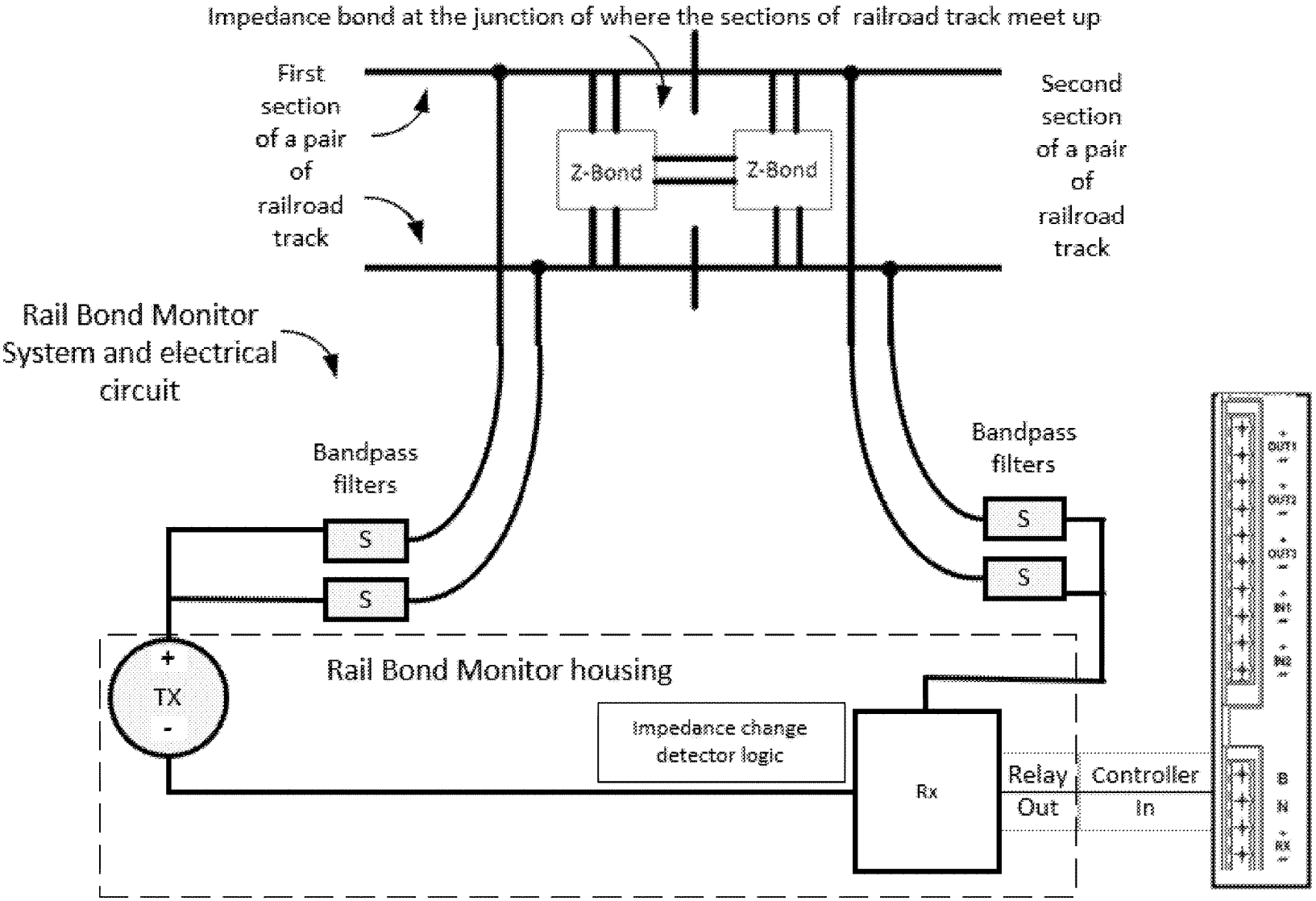
FIG. 3 illustrates a wiring diagram of an embodiment of an example rail bond monitor and an example associated electrical circuit.

FIG. 3 illustrates a wiring diagram of an embodiment of an example rail bond monitor and an example associated electrical circuit. The example rail bond monitoring system includes a housing that includes a transmitter, a receiver, an energy level detector 122 (e.g., an electrical circuit or another logic) to determine a change of impedance, an example of four electrical connections to the railroad track propulsion circuit where each has its own electrical circuit, such as a bandpass circuit, to isolate the rail bond monitor 100 internals from affecting the railroad track propulsion circuit, and another electrical connection for a relay output 144 to supply a signal into the rail controller.

The energy level detector 122 coupled to the receiver is configured to detect the energy level change as an impedance change in the impedance bonds themselves and/or in the electrical paths between the railroad tracks and the impedance bonds, at the given insulated rail.

Also, shown are two sections, each section with a pair of railroad tracks and its own impedance bond between the pair of railroad tracks and then the coupling between two sections of railroad track. The impedance bond on each side of the insulated rail joint is shown by the Z bonds with two pairs of wires going between the impedance bond on one side and the other side of the tracks. Thus, making a total of four pairs, two on each side of the insulted rail joint. A fifth pair of wires goes between the two impedance bonds. Again, the insulated joints at the junction of the two sections of the train track are indicated by black lines at 90 degree angles to the railroad tracks, which are going parallel across the diagram.

The rail bond monitor 100 monitors the bonding between the tracks, each pair of bond wires (rail bonds) between the impedance bonds and the tracks. The rail bond monitor 100 can indicate when a problem exists with an electrical return path for a propulsion system for a train. Either the impedance bonds themselves may have a problem and/or the bonding wires between the impedance bonds and the tracks may have a problem.

As discussed more in detail below, the rail bond monitor 100 housing can contain its own Audio Frequency (AF) overlay track circuit 110. The frequency transmitter in the AF overlay track circuit 110 introduces an audio signal of a specific assigned carrier frequency and modulation rate into the track circuit through wires connected directly to the railroad tracks, via tuned filters, through the impedance bonds back, through tuned filters to a receiver. There is an output relay connected to the output of the receiver portion of the rail controller. The tuned filters are tuned to pass the audio frequency generated by frequency transmitter in the AF overlay track circuit 110 and isolate the rail bond monitor 100 from introducing or receiving audio frequencies outside of the expected range of the audio frequency generated by the frequency transmitter. In an example, a narrow band shunt (inductor-capacitor circuit) can be used for each bandpass filter to pass audio frequencies from the transmitter of the rail bond monitor 100 and decouple/isolate the rail bond monitor 100 from the rail propulsion electrical circuit/system. The bandpass filtering filters out most of the audio frequencies, besides its set range of audio frequencies to pass, so that the rail bond monitor 100 itself does not interfere with the railroad propulsion circuit and/or the traditional track circuit that forms part of the broader rail signaling system. The narrow band shunts can be encapsulated in a weather-proof housing. Note, as discussed later, active filtering (such as an operational amplifier tuned circuit) can also be used rather than just a passive inductive capacitance based bandpass filter.

Two or more tuned filter circuits are configured to isolate at least one of i) electrical signals and ii) electrical shorts coming from the rail bond monitor 100 from electrically interfering with operations of a railroad track circuit implemented by the railroad tracks. The tuned filter circuit, such as hardware filtering inductive-capacitance circuits/couplers and/or software defined filtering, acts as a bandpass filter. A first tuned filter circuit is electrically coupled to the frequency transmitter. A second tuned filter circuit is electrically coupled to the receiver. The two or more tuned filter circuits in an example are inductive-capacitance circuits/couplers configured to act as a bandpass filter. The electrical leads 133 are configured to connect directly to the railroad track circuit and then down to the railroad tracks, via one or more tuned filters, through the impedance bonds, and back through one or more tuned filters to the receiver. The tuned filters can be tuned to pass the frequency wavelength that the transmitter is configured to generate. The transmitted frequency signal will pass through a supply set and a return set of bandpass filters tuned to a specific frequency range that corresponds to the same frequency that the transmitter is configured will be set to. Again, the transmitted audio frequency signal passes through the rails of the train track itself and then through the two impedance bonds and their combined five connections to be received in the receiver. Note, when the frequency transmitter in the overlay track circuit 110 is configured to generate electrical signals in an audio frequency range then the two or more tuned filter circuits are bandpass filters configured to pass electrical signals in the audio frequency range and reject/block electrical signals outside of the audio frequency range. The shunt bandpass couplers are tuned to the transmit frequency so that the energy level detector 122 is just monitoring for that specific signaling and can tell when there is a difference pretty easily.

FIG. 3 also shows four electrical connections from the rail bond monitor to the railroad track circuit itself that straddle across the two back to back impedance bonds between the two sections of rail. There are two electrical connections on the left-hand side of the left impedance bond which traveled down to the rail bond monitor 100. There are two electrical connections on the right-hand side of the right impedance bond that also go down and supply input into a rail bond monitor 100. Those four connections straddle the two sides of the back-to-back impedance bonds. As discussed, each of the four electrical leads 133 has its own bandpass filter. The frequency transmitter generates an audio frequency signal that passes through the bandpass filters on the left-hand side of FIG. 3 onto the rails the railroad tracks and then through a first impedance bond and its associated rail connections. After passing through the first impedance bond and its associated rail connections, then the audio frequency signal from the transmitter passes through a second impedance bond located on an opposite side of the insulated rail junction than the first impedance bond and then goes into the electrical leads 133 and their associated bandpass filters onto the receiver.

Again, the impedance bonds are used to block signals in the frequency range for the traditional track circuit that forms part of the broader rail signaling system, which comprises many parts to enable trains to move safely around the network. However, the rail bond monitor 100 is using the impedance bonds to pass signals for the impedance bond monitoring. Again, the audio frequency signal passes through the example two parallel electrical paths, each with its own bandpass filter, to its own railroad track on the left-hand side. The audio signal from the transmitter from the two tracks passes through each of the rail tracks and through the impedance bonds and if one or more wires are broken/damaged then that impedance goes up and is detectable. Same on the right-hand side, when the audio signal from the transmitter passes through the back-to-back impedance bonds to the right-hand side and if one or more wires are broken/damaged then that impedance goes up and is detectable.

The audio frequency signal from the rail bond monitor 100 passes through the impedance bonds and their associated rail connections into the bandpass filters on the right-hand side to be received in the receiver so that the energy level detector 122 within the rail bond monitor 100 can detect an impedance change when a fault or damage occurs with any of the five pairs of leads going to the railroad and/or transit track circuit or either of the impedance bonds themselves. The energy level detector 122 will when it detects a change in the impedance indicated by a change in the level of energy (energy=voltage times current, and current=voltage divided by resistance including any impedance) from the impedance bonds and their associated rail bonds. The energy level detector 122 interprets that as something is wrong with the impedance bonds at that insulated rail junction between two sections of track. When the transmit audio frequency signal from the transmitter is received in the receiver, then the energy level detector 122 verifies what is the energy level of the received signal. When that energy is at a threshold proper level, then that indicates the impedance bonds and their wiring connecting between the tracks and themselves is in tack. When that energy of the transmit audio frequency signal is not at the proper level, then that is what triggers the relay drive to output the warning. A relay output 144 will be triggered, and an output sent as an input into the wayside controller to send a warning about the impedance bonds at that insulated rail junction. Thus, the energy level detector 122 in the rail bond monitor 100 will detect the change in impedance and then communicate the detected condition through the relay output 144 over into the rail controller interface to send a warning. When these rail bonds and/or the impedance bonds themselves are missing, broken, or damaged, the integrity of the railroad/transit track system overall is affected.

In addition, the rail bond monitoring system will allow, in conjunction with the broken rail detection system for a set of railroad tracks, will provide end-to-end assurance of the complete electrical return system when a problem exists with an electrical return path for a propulsion system for a train. The complete electrical return system has a primary to supply the voltage and then many parallel paths of return to the voltage source. If you lose an electrical path of return in the set of parallel electrical paths of return in the electrical propulsion system, now the rail bond monitor 100 system will let you know it and the specific rail bond monitor 100 at that insulated rail junction will let you know exactly where the problem is. Before if you lost an electrical parallel path, you do not know it. Thus, the integrity of the entire electrical return system can now be assured consistently. The rail bond monitor 100 uses portions of both the railroad electrical propulsion system and the railroad signaling system to monitor the railroad propulsion system to ensure the complete integrity of the rail return system in the railroad propulsion system.

Figure 4:
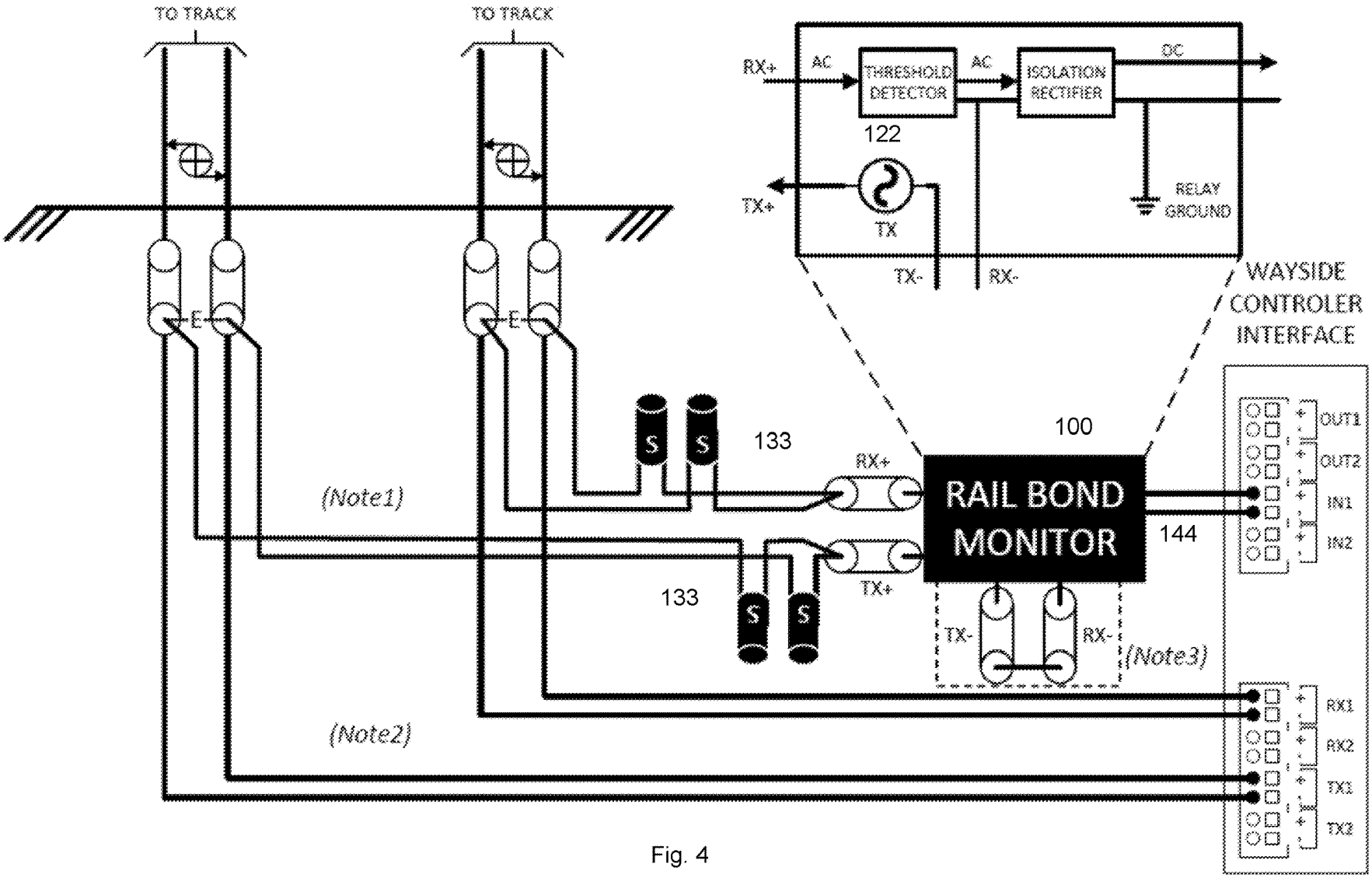
FIG. 4 shows an example wiring diagram that can be corresponded to FIG. 3 as discussed.

FIG. 4 shows an example wiring diagram that can be corresponded to FIG. 3 as discussed. In this example, two leads coming from the rail bond monitor 100 connect into wiring connecting to the tracks on the left-hand side of FIG. 3. The impedance bonds from FIG. 3 are not shown. However, the wiring connecting to the right-hand side of the impedance bonds are shown. The example two leads of the rail bond monitor 100 on the right-hand side connect to the wiring and pass the transmit audio frequency signal through the bandpass filters/shunts shown by the black cylinders into the rail bond monitor 100. Note, the lead coming from the rail bond monitor 100 on the left-hand side also pass through the bandpass filters/shunts shown by the black cylinders into the wires connecting to the tracks. The energy level detector 122 can have a threshold detector. Lastly, the relay output 144 from the rail bond monitor 100 has leads as well as an isolation rectifier to connect into an example wayside controller interface. Note, the rail bond monitoring PLC microprocessors or signaling processors usually have standard inputs and outputs.

Figure 5:
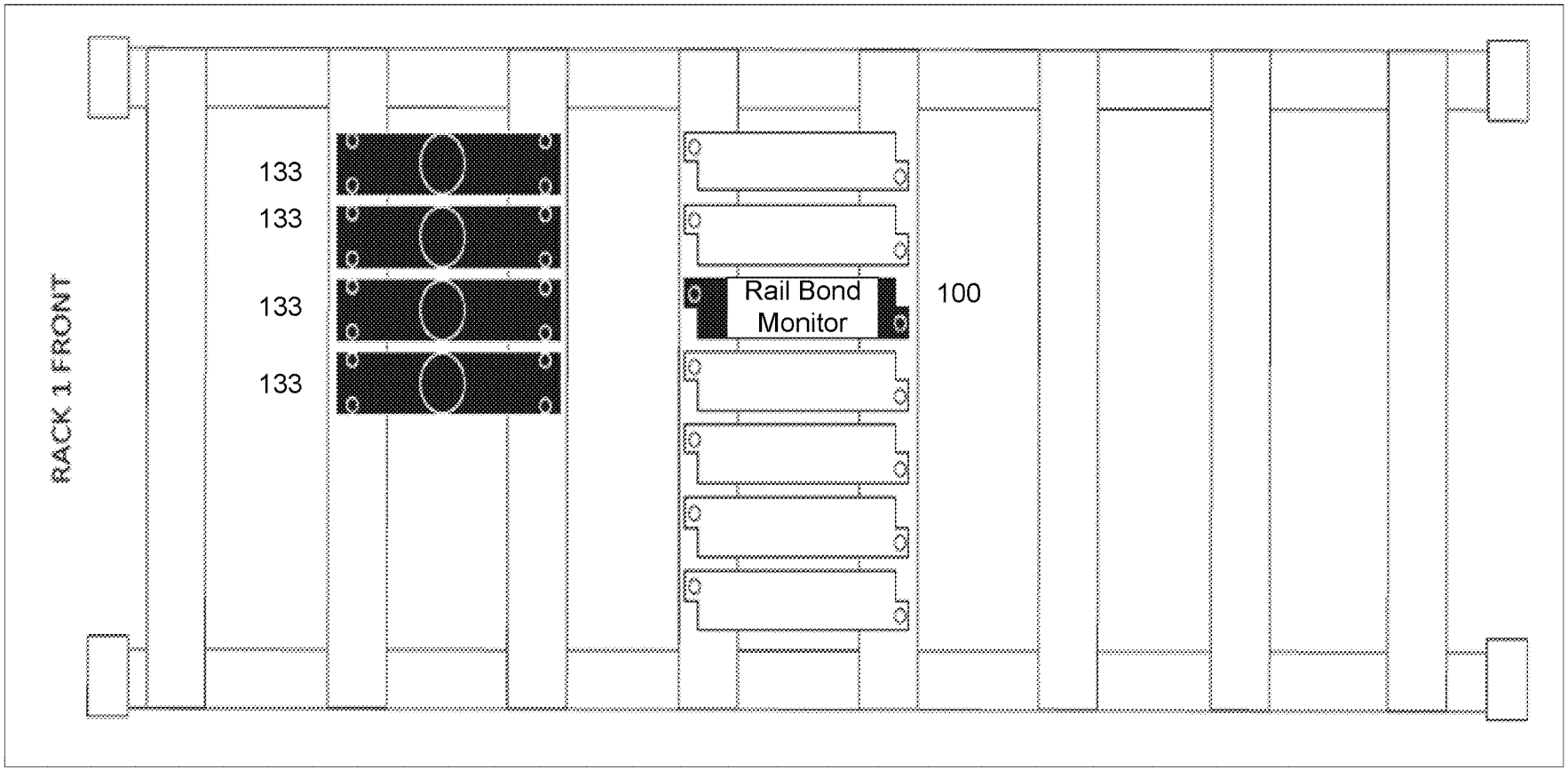
FIG. 5 illustrates a rack diagram of an embodiment of an example rail bond monitor and its bandpass filters installed in that rack.

FIG. 5 illustrates a rack diagram of an embodiment of an example rail bond monitor and its bandpass filters installed in that rack. The rack houses the rail bond monitor 100 and its bandpass filters installed for the tracks circuit. The bandpass filters are indicated by the rectangular block with circles.

Note, the frequency transmitter in each rail bond monitor 100 can transmit audio frequencies, for example, at frequencies between 120 Hz and 20,000 Hz so long as it does not interfere with any of the other frequencies that are present on the railroad track circuit and/or electrical propulsion system. The transmitted audio frequency signal will pass through a supply set and a return set of bandpass filters tuned to a specific frequency range that corresponds to the exact audio frequency that the transmitter will be set to. Again, the transmitted audio frequency signal passes through the two impedance bonds and their combined five connections to be received in the receiver and based upon the impedance detected in the impedance bonds and their associated wiring, the audio frequency signal will be interpreted by the logic in the receiver as everything's OK with the five pairs of leads and the impedance bonds OR that damage exists and should be investigated at that specific meeting/insulated rail junction between two sections of railroad track.

Some background. A typical track circuit is located and electrically connected between the two insulated joints does not pass a signal through the impedance bonds and will be operating at a different audio frequency than the rail bond monitor 100.

Typically, an in-person inspection of each rail bond between sections of the railroad track at an insulated rail junction must occur rather than a remote monitoring of the rail bond connection. The rail bond monitor 100 allows remote detection of a complete failure of a rail bond, a merely damaged/degraded rail bond and/or compromised integrity of the impedance bonds, even a removal/theft of a rail bond jumper, and/or the bond leads from the rail bond monitor 100 have fallen off, and not necessarily that the rail bond itself and/or the impedance bond has failed. Once the rail bond monitor 100 indicates a problem exists (e.g., damage or lose the balanced path), then someone has got to go out and look at it.

Likewise, in some previous cases, companies would encase the brass or copper rail bond jumper after it is installed to make the electrical connection between rail sections in concrete to prevent the theft of the copper or brass jumper from the railroad track. Now, remote detection can occur to instantly notify the railroad personnel of a problem with the rail bond and/or impedance bond at a specific insulted rail junction/connection between sections of the railroad. Thus, no concrete or other similar type of barrier may be needed after installing the rail bond jumper; and thus, lower the cost of installation of the rail bonds and impedance bonds.

Figure 6:
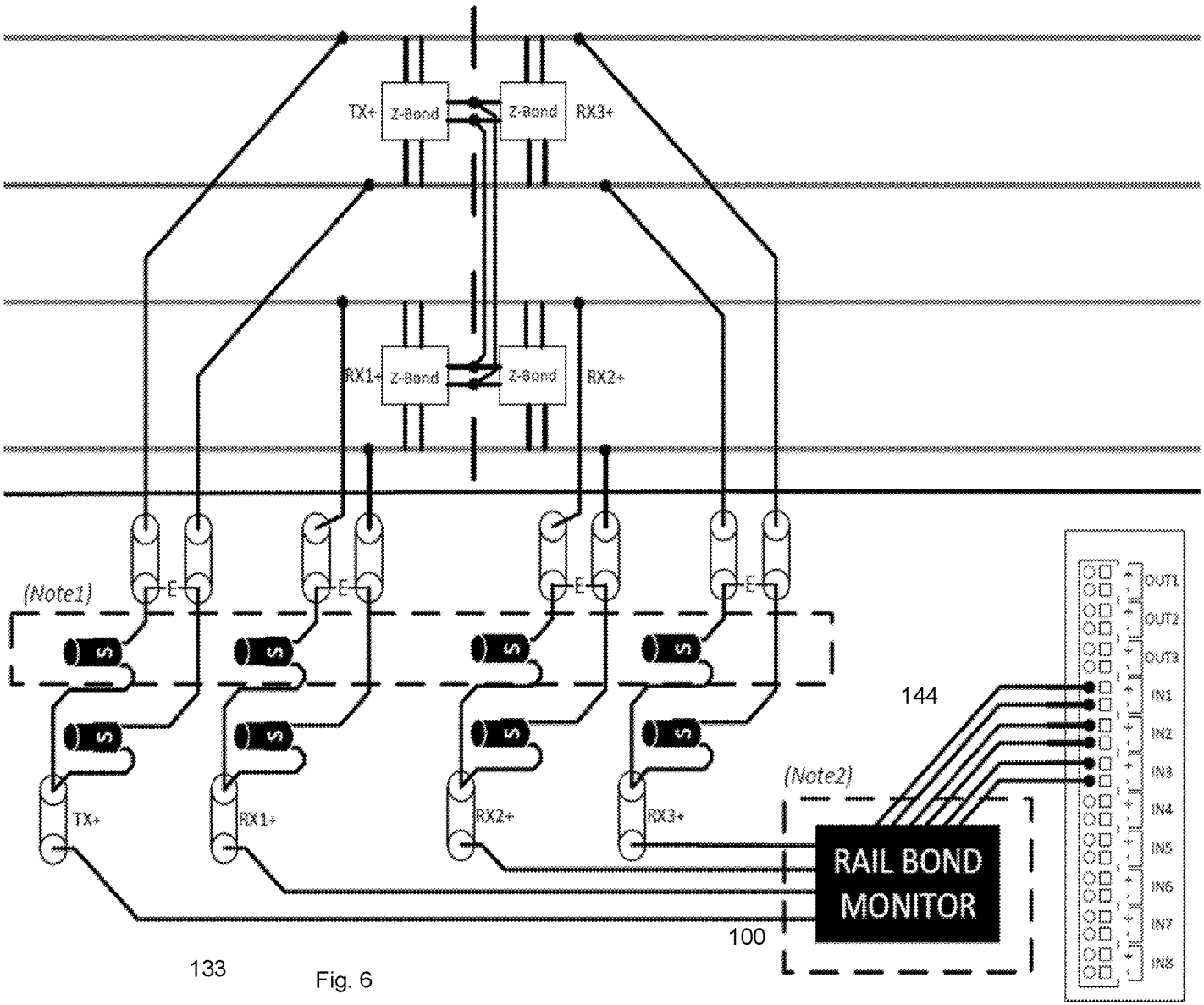
FIG. 6 illustrates a rack diagram of an embodiment of an example rail bond monitor for a double track set of railroad tracks.

FIG. 6 illustrates a rack diagram of an embodiment of an example rail bond monitor for a double track set of railroad tracks. The rail bond monitor 100 can contain one frequency transmitter and multiple receivers. Each receiver is configured to connect to its own set of railroad tracks and its own associated impedance bond at the junction of where the insulated sections of the railroad track meet up.

This example double track has impedance bonds at the insulated joints on both sets of tracks. Four connections come from the rail bond monitor 100 with one frequency transmitter and three receivers. The frequency transmitter generates a signal to induce electrical current through the railroad track and the back to back impedance bonds. The signal goes common mode through the back to back impedance bonds. The first transmitter frequency goes through the first impedance bond and then onto a second back to back impedance bond on the top railroad tracks and then goes to receiver 3. The first transmitter frequency also goes through the first impedance bond and then onto a third back to back impedance bond on the bottom railroad tracks and then goes to receiver 1. The first transmitter frequency goes through the first impedance bond and then onto a fourth back to back impedance bond on the bottom railroad tracks and then goes to receiver 2. The transmitter injects a differential, a common mode signal through the back to back impedance bonds and the impedance bonds act as auto transformers. As auto transformers, the common mode path is near zero impedance. When one of the side leads breaks in the impedance bond electrical paths, then the impedance level will probably jump to the 10 to 20 Ohm range because there is no longer a common mode situation, even though the track may still have an electrical path through the remaining electrical paths through those back to back impedance bonds. However, if the track loses any one of those bonding paths, side leads, or the back to back impendence bonds themselves, then this will substantially change the receive electrical current. The auto transforming impact of these impedance bonds shows the significance difference in detected energy levels because of the loss of the common mode of the injected signal. The energy level detector 122 reads the electrical current on these wires. A change in the impedance bond is detectable. It is because there will be a differential signal through the impedance bond, so there should not be any significant change. The energy level detector 122 (e.g., electronic circuit and/or other logic) is configured to detect the signal energy level and compare this current signal energy level under analysis from an expected amount of energy level received at the receiver in the rail bond monitor 100. The signal from the transmitter flows through the back to back impedance bonds and then the receiver receives approximately the same signal energy level within reason. When a problem exists such as a wire is loose, the impedance bonds has been disconnected, etc., then the energy level detector 122 tracks and detects the difference between the energy signal level transmitted by the frequency transmitter and the energy signal level present at the receiver. When there is any significance between them, then there is a problem with the impedance bond and/or its electrical pathways from the railroad track through these back to back impedance bonds.

Figure 7:
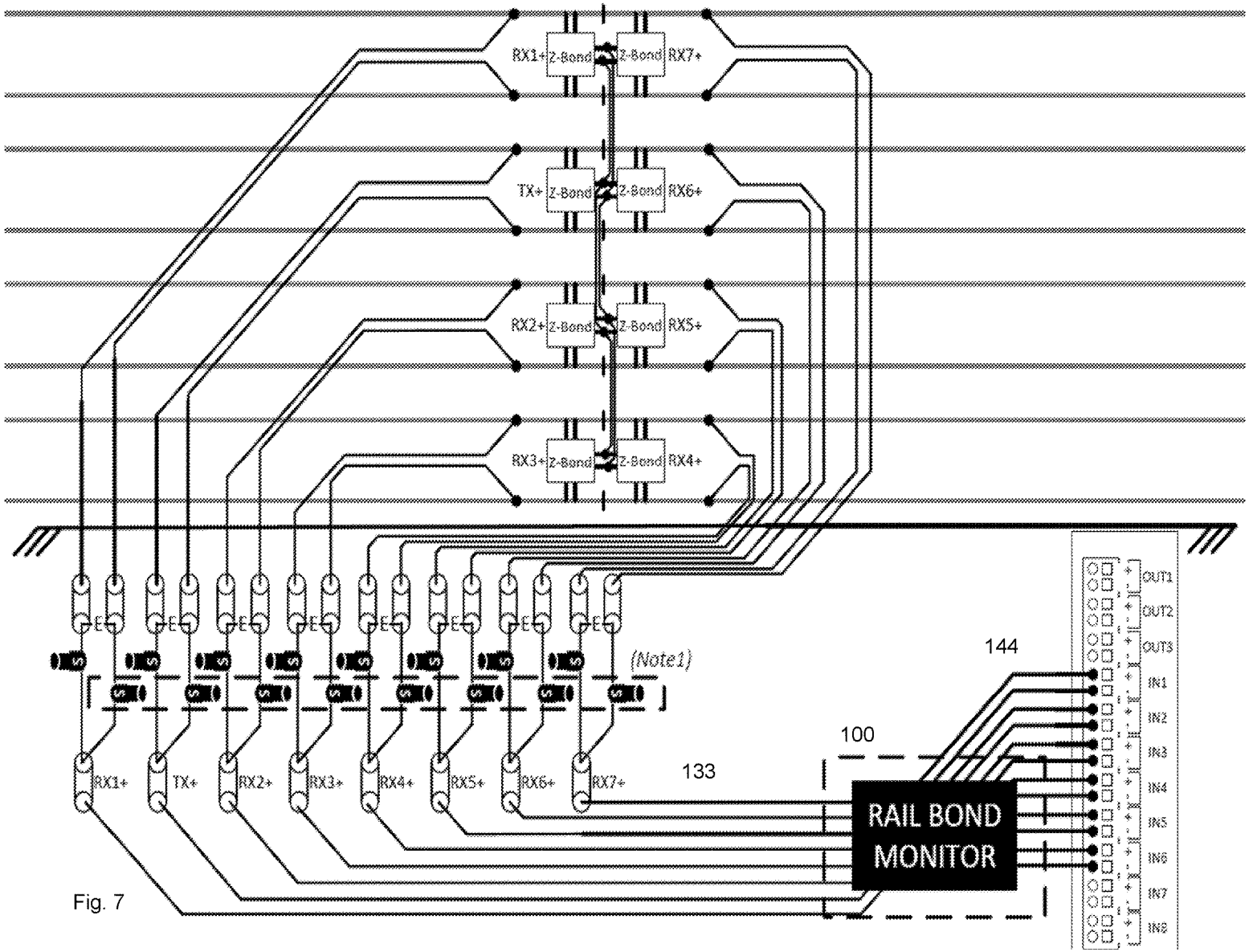
FIG. 7 illustrates a wiring diagram of an embodiment of an example rail bond monitor on a quad set of railroad tracks that operates similar to FIG. 6.

FIG. 7 illustrates a wiring diagram of an embodiment of an example rail bond monitor on a quad set of railroad tracks that operates similar to FIG. 6. This rail bond monitor 100 has one transmitter and seven receivers.

Figure 8:
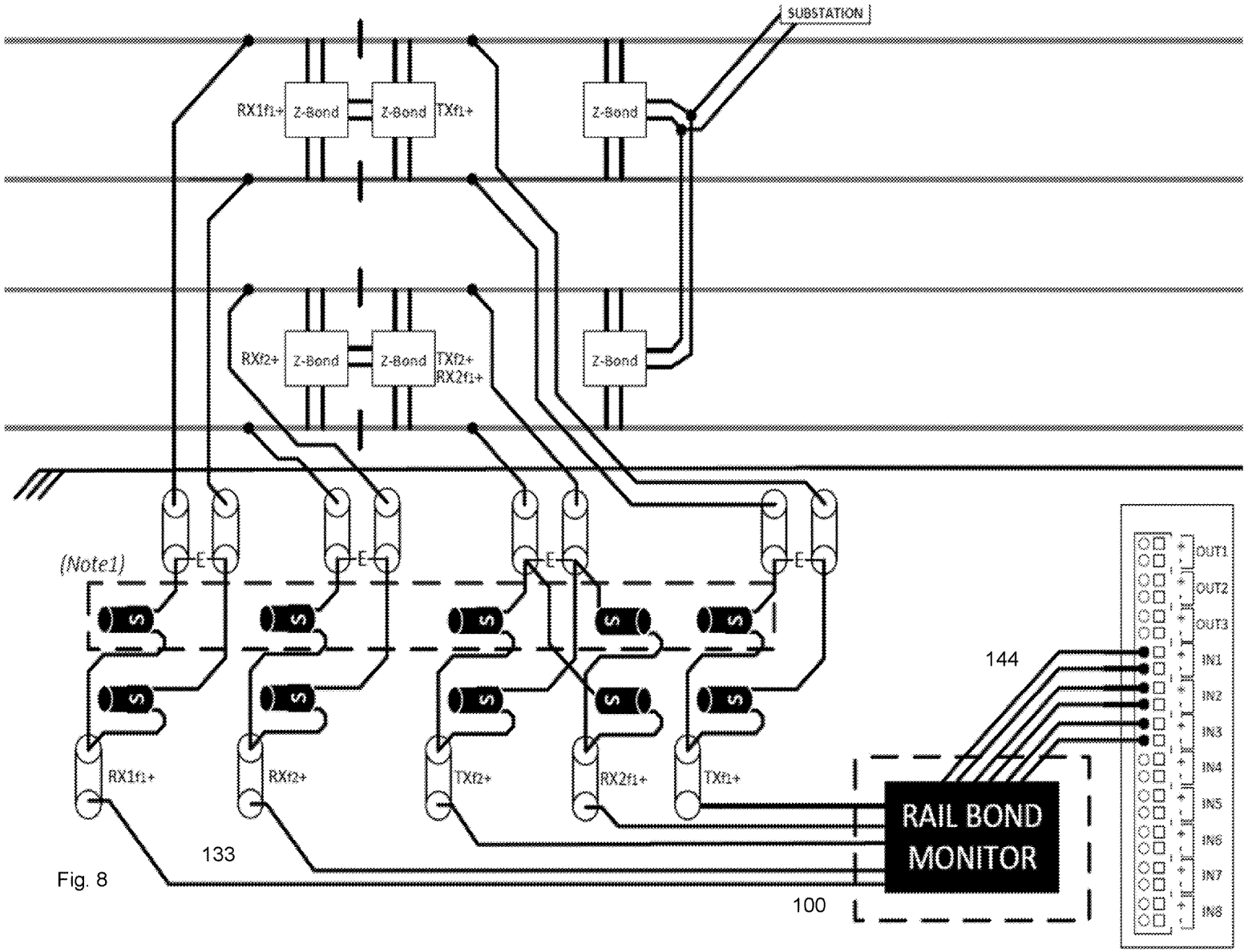
FIG. 8 illustrates a wiring diagram of an embodiment of an example rail bond monitor for a double track set of railroad tracks with a drain bond.

FIG. 8 illustrates a wiring diagram of an embodiment of an example rail bond monitor for a double track set of railroad tracks with a drain bond. The rail bond monitor 100 contains multiple frequency transmitters and multiple receivers. Each frequency transmitter is configured to transmit a different frequency than the other transmitters wavelength to multiple receivers, in a railroad track that implements a drain bond, to detect that the problem exists with at least one of i) an electrical condition at the impedance bonds themselves as well as ii) an electrical condition of electrical paths between the railroad tracks and the impedance bonds, at the given insulated rail junction.

This example double track has impedance bonds at the insulated joints as well as a drain bond. Five connections come from the rail bond monitor 100 with two frequency transmitters and two receivers. The first frequency transmitter generates a signal to induce electrical current through the railroad track and a first set of back to back impedance bonds. The frequency transmitter is transmitting an electronic signal through these isolating couplers onto the rail in a differential format. The frequency transmitter transmits onto both rails equally. The electronic signal auto transforms through a center tab which is equally distributed to the second impedance bond. The drain bond goes across the double tracks somewhere else at another location on the train tracks. The electrical transmit signal goes down the rail differentially. A first transmitter frequency goes through the bandpass couplers goes through and inserts onto the railroad tracks near the impedance bonds. The first transmitter frequency goes through the first impedance bond and then onto a second back to back impedance bond going to the receiver 1. The first transmitter frequency also goes through the drain bond. A second transmitter frequency goes through the bandpass couplers and inserts onto the railroad tracks near the impedance bonds on the second set of train tracks as well as onto the back side of the drain bond. The second receiver receives the second frequency on the back side of the impedance bonds on the second set of railroad tracks as well as the first frequency on the back side of the drain bond.

Figure 9:
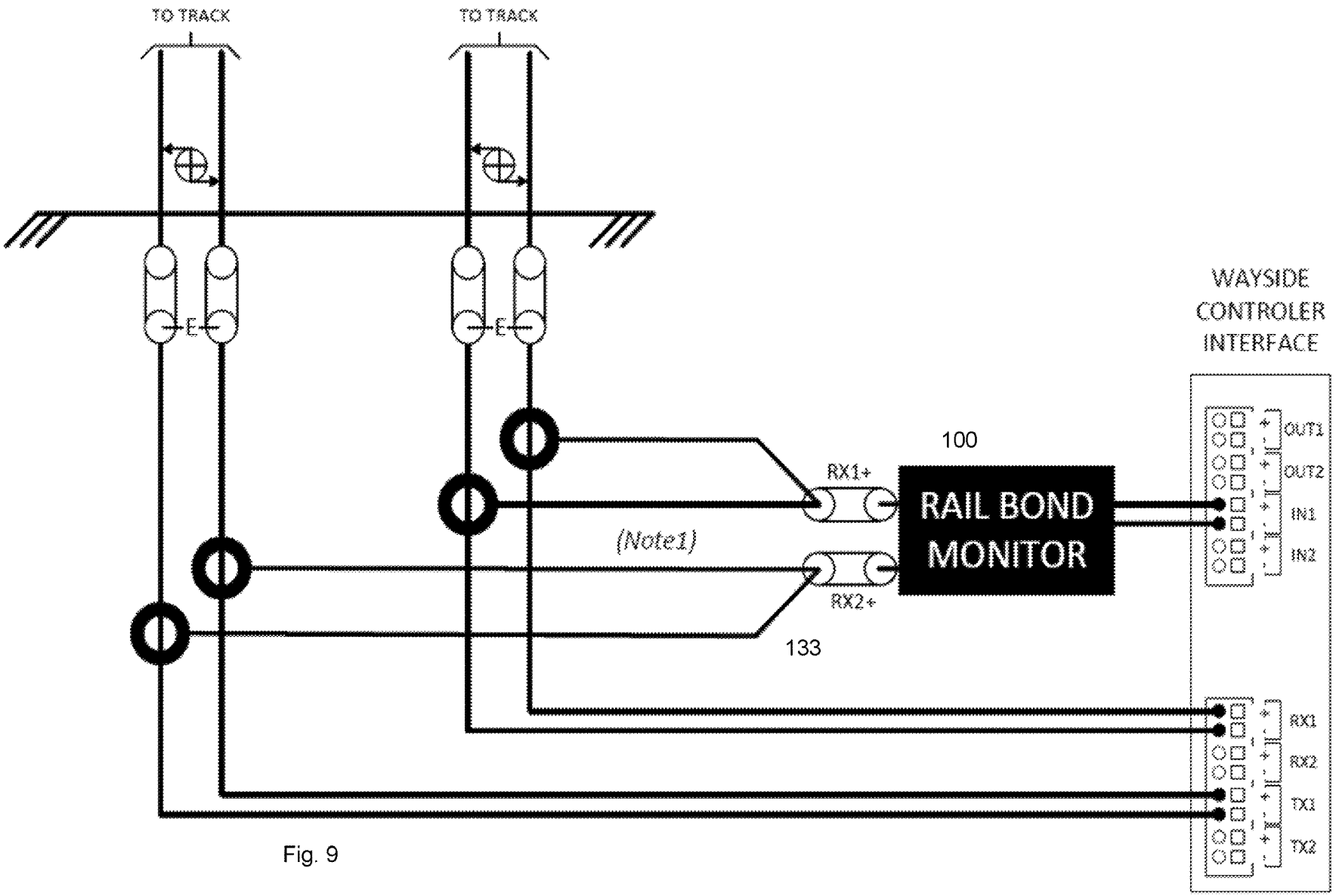
FIG. 9 illustrates a wiring diagram of an embodiment of an example non-invasive rail bond monitor with two receivers in the rail bond monitor—a first receiver and a second receiver that combine to perform non-invasive signal detection and monitoring.

FIG. 9 illustrates a wiring diagram of an embodiment of an example non-invasive rail bond monitor with two receivers in the rail bond monitor—a first receiver and a second receiver that combine to perform non-invasive signal detection and monitoring. This is done by electrical current monitoring on any combination of track wires to the rail.

Two electrical leads 133 (e.g., wires) go from a first receiver that go to the railroad track, then go through the back to back impedance bonds at the insulated junction and eventually coming back through two electrical leads 133 on the other side of the second impedance bond to the second receiver at the rail bond monitor 100. The energy level detector 122 (e.g., electronic circuit and/or other logic) is set to detect steady state electrical current changes (e.g., the signal measured is steady state electrical current changes because there is no frequency transmitter to induce any electrical current through the railroad track and the back to back impedance bonds). The energy level detector 122 now just purely reads the electrical current on these wires. Under steady state electrical current detected in the rail bond monitor 100, any kind of change in one of these electrical leads 133 would indicate that there is a change in the impedance bond. It is because there will be a differential signal through the impedance bond, so there should not be any significant change. The energy level detector 122 is configured to detect the signal energy level and compare this current signal energy level under analysis from an expect amount of energy level received at the receiver in the rail bond monitor 100. This is an alternate solution to monitor the impedance bonds and the electrical path through these impedance bonds than some earlier described implementations.

Normally in the earlier implementations, the electronic signal actively generated from the frequency transmitter flows through the back to back impedance bonds. The receiver then reads the same signal energy level within reason. In this implementation, one side will have a certain level of power detected at the first receiver and a certain level of power detected at the second receiver. When a difference in expected power levels going through one leg is detected, then a defect in the impedance bonds is detected. Thus, the rail bond monitor 100 tracks and detects the difference between energy signal levels present those two receivers, and if there is any significance between them, then there is a problem with the impedance bond and/or its electrical pathways from the railroad track through these back to back impedance bonds. Generally, when a train comes onto the set of railroad tracks, then the electrical signal received, the level levels will go significantly lower. This would be followed rapidly by the electrical signal received by the second receiver will also go significantly lower by approximately the same proportion as the drop on the adjacent set of tracks.

Next, the drawings show two example controllers and other specifics about the track circuit. One example rail controller from Siemens is a phase shift overlay. Another example rail controller from Ge is an AFTAC II.

Computing Systems

Figure 10:
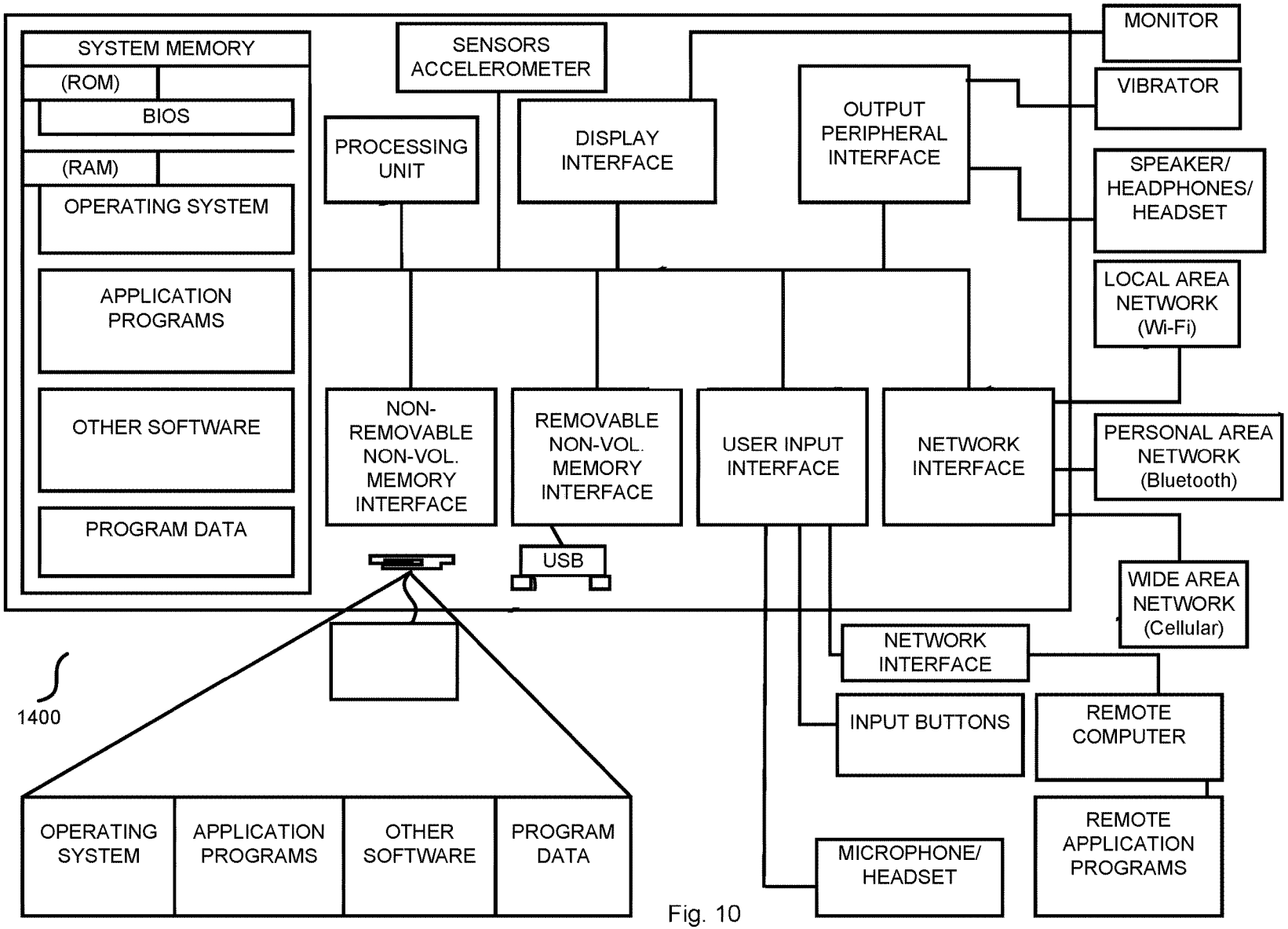
FIG. 10 illustrates a block diagram of an embodiment of an example computing device that can be implemented as portions of the rail bond monitor.

FIG. 10 illustrates a block diagram of an embodiment of an example computing device that can be implemented as portions of the rail bond monitor 100. A computing system 1400 can be, wholly or partially, part of one or more of the server or client computing devices in accordance with some embodiments. The computing system 1400 are specifically configured and adapted to carry out the processes discussed herein. Components of the computing system 1400 can include, but are not limited to, a processing unit having one or more processing cores, a system memory, and a system bus that couples various system components including the system memory to the processing unit. The system bus may be any of several types of bus structures selected from a memory bus or memory controller, a peripheral bus, and a local bus using any of a variety of bus architectures.

The computing system 1400 typically includes a variety of computing machine-readable media. Computing machine-readable media can be any available media that can be accessed by computing system and includes both volatile and nonvolatile media, and removable and non-removable media. By way of example, and not limitation, computing machine-readable media use includes storage of information, such as computer-readable instructions, data structures, other executable software, or other data. Computer-storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other tangible medium which can be used to store the desired information and which can be accessed by the computing device 900. Transitory media such as wireless channels are not included in the machine-readable media. Communication media typically embody computer readable instructions, data structures, other executable software, or other transport mechanism and includes any information delivery media.

The system memory includes computer storage media in the form of volatile and/or nonvolatile memory such as read only memory (ROM) and random access memory (RAM). A basic input/output system (BIOS) containing the basic routines that help to transfer information between elements within the computing system, such as during start-up, is typically stored in ROM. RAM typically contains data and/or software that are immediately accessible to and/or presently being operated on by the processing unit. By way of example, and not limitation, the RAM can include a portion of the operating system, application programs, other executable software, and program data.

The drives and their associated computer storage media discussed above, provide storage of computer readable instructions, data structures, other executable software, and other data for the computing system.

A user may enter commands and information into the computing system through input devices such as a keyboard, touchscreen, or software or hardware input buttons, a microphone, a pointing device and/or scrolling input component, such as a mouse, trackball, or touch pad. The microphone can cooperate with speech recognition software. These and other input devices are often connected to the processing unit through a user input interface that is coupled to the system bus, but can be connected by other interface and bus structures, such as a parallel port, game port, or a universal serial bus (USB). A display monitor or other type of display screen device is also connected to the system bus via an interface, such as a display interface. In addition to the monitor, computing devices may also include other peripheral output devices such as speakers, a vibrator, lights, and other output devices, which may be connected through an output peripheral interface.

The computing system can operate in a networked environment using logical connections to one or more remote computers/client devices, such as a remote computing system. The logical connections can include a personal area network ("PAN") (e.g., Bluetooth®), a local area network ("LAN") (e.g., Wi-Fi), and a wide area network ("WAN") (e.g., cellular network), but may also include other networks. Such networking environments are commonplace in offices, enterprise-wide computer networks, intranets, and the Internet. A browser application may be resident on the computing device and stored in the memory.

It should be noted that the present design can be carried out on a computing system. However, the present design can be carried out on a server, a computing device devoted to message handling, or on a distributed system in which different portions of the present design are carried out on different parts of the distributed computing system.

Another device that may be coupled to bus is a power supply such as a DC power supply (e.g., battery) or an AC adapter circuit. As discussed above, the DC power supply may be a battery, a fuel cell, or similar DC power source that needs to be recharged on a periodic basis. A wireless communication module can employ a Wireless Application Protocol to establish a wireless communication channel. The wireless communication module can implement a wireless networking standard.

In some embodiments, software used to facilitate algorithms discussed herein can be embodied onto a non-transitory machine-readable medium. A machine-readable medium includes any mechanism that stores information in a form readable by a machine (e.g., a computer). For example, a non-transitory machine-readable medium can include read only memory (ROM); random access memory (RAM); magnetic disk storage media; optical storage media; flash memory devices; Digital Versatile Disc (DVD's), EPROMS, EEPROMs, FLASH memory, magnetic or optical cards, or any type of media suitable for storing electronic instructions.

Note, an application described herein includes but is not limited to software applications, mobile apps, and programs that are part of an operating system application. Some portions of this description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. These algorithms can be written in a number of different software programming languages such as C, C+, or other similar languages. Also, an algorithm can be implemented with lines of code in software, configured logic gates in software, or a combination of both. In an embodiment, the logic consists of electronic circuits that follow the rules of Boolean Logic, software that contain patterns of instructions, or any combination of both. A module can be implemented in electronic hardware, software instruction cooperating with one or more memories for storage and one of more processors for execution, and a combination of electronic hardware circuitry cooperating with software.

It should be borne in mind, however, that all of these and similar terms are to be associated with the appropriate physical quantities and are merely convenient labels applied to these quantities. Unless specifically stated otherwise as apparent from the above discussions, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers, or other such information storage, transmission or display devices.

Many functions performed by electronic hardware components can be duplicated by software emulation. Thus, a software program written to accomplish those same functions can emulate the functionality of the hardware components in input-output circuitry.

While the foregoing design and embodiments thereof have been provided in considerable detail, it is not the intention of the applicant(s) for the design and embodiments provided herein to be limiting. Additional adaptations and/or modifications are possible, and, in broader aspects, these adaptations and/or modifications are also encompassed. Accordingly, departures may be made from the foregoing design and embodiments without departing from the scope afforded by the following claims, which scope is only limited by the claims when appropriately construed.

The invention claimed is:

1. An apparatus, comprising a rail bond monitor that has an overlay track circuit with at least one frequency transmitter configured to generate an electronic signal at a known energy level to pass through two or more impedance bonds located at an insulated rail junction between two sections of railroad tracks in order to allow a change in energy level, under analysis, at a receiver to be detected from an expected amount of energy level, an energy level detector coupled to the receiver is configured to detect the energy level under analysis at the receiver and compare that to the expected amount of energy level, and then generate a notice signal configured to trigger a relay output when the change in energy level under analysis is beyond a threshold amount, multiple electrical leads configured to affix to track leads in a track circuit, where a first set of electrical leads, which are connected to the frequency transmitter, are configured to connect to a first impedance bond located at the insulated rail junction between the two sections of the railroad track, where a second set of electrical leads, which are connected to the receiver, are configured to connect to a second impedance bond located on an opposite side of the insulated rail junction than the first impedance bond, where the relay output is coupled to the energy level detector and has one or more output leads that go into one or more inputs of a rail controller to act as a warning that a problem exists with at least one of i) an electrical condition at the impedance bonds themselves as well as ii) an electrical condition of electrical paths between the railroad tracks and the impedance bonds, at a given insulated rail junction, where the relay output is configured to change when the detected change in the energy level under analysis is beyond the threshold amount, and where the rail bond monitor is configured to provide a warning system, through detected change in the energy level, that the problem exists with at least one of i) an electrical condition at the impedance bonds themselves as well as ii) an electrical condition of electrical paths between the railroad tracks and the impedance bonds, at the given insulated rail junction.

2. The apparatus of claim 1, further comprising:

two or more tuned filter circuits configured to isolate at least one of i) electrical signals and ii) electrical shorts coming from the rail bond monitor from electrically interfering with operations of a track circuit implemented by the railroad tracks, where a first tuned filter circuit is electrically coupled to the frequency transmitter, where a second tuned filter circuit is electrically coupled to the receiver.

3. The apparatus of claim 2, where the two or more tuned filter circuits are inductive-capacitance circuits configured to act as a bandpass filter.

4. The apparatus of claim 2, where the frequency transmitter in the overlay track circuit is configured to generate electrical signals in an audio frequency range.

5. The apparatus of claim 1, where the energy level detector coupled to the receiver is configured to detect the energy level change as an impedance change in the impedance bonds themselves and/or in the electrical paths between the railroad tracks and the impedance bonds, at the given insulated rail.

6. The apparatus of claim 1, where the rail bond monitoring system will allow, in conjunction with a broken rail detection system for a set of railroad tracks, will provide end-to-end assurance of a complete electrical return system when a problem exists with an electrical return path for a propulsion system for a train.

7. The apparatus of claim 1, where each of the electrical leads has its own bandpass filter, where the frequency transmitter is configured to generate an audio frequency signal that passes through the bandpass filters onto the railroad tracks and then through a first impedance bond and its associated rail connections, where after passing through the first impedance bond and its associated rail connections, then the audio frequency signal from the transmitter passes through a second impedance bond located on an opposite side of the insulated rail junction than the first impedance bond and then goes into the electrical leads and their associated bandpass filters onto the receiver.

8. The apparatus of claim 1, where the rail bond monitor further contains multiple receivers, where each receiver is configured to connect to its own set of railroad tracks and its own associated impedance bond at the junction of where the insulated sections of the railroad track meet up.

9. The apparatus of claim 1, where the electrical leads are configured to connect directly to the track circuit down to the railroad tracks, via one or more tuned filters, through the impedance bonds, and back through one or more tuned filters to the receiver, where the tuned filters are tuned to pass a frequency wavelength that the transmitter is configured to generate.

10. The apparatus of claim 1, where the rail bond monitor further contains multiple frequency transmitters, where each frequency transmitter is configured to transmit a different frequency than the other transmitters wavelength to multiple receivers, in a railroad track that implements a drain bond, to detect that the problem exists with at least one of i) an electrical condition at the impedance bonds themselves as well as ii) an electrical condition of electrical paths between the railroad tracks and the impedance bonds, at the given insulated rail junction.

11. A method for monitoring a railway, comprising providing a rail bond monitor that has an overlay track circuit, an energy level detector, multiple electrical leads, and a relay output, providing the overlay track circuit with at least one frequency transmitter to generate an electronic signal at a known energy level to pass through two or more impedance bonds located at an insulated rail junction between two sections of railroad tracks in order to allow a change in energy level, under analysis, at a receiver to be detected from an expected amount of energy level, providing the energy level detector coupled to the receiver to detect the energy level under analysis at the receiver and compare that to the expected amount of energy level, and then generate a notice signal configured to trigger a relay output when the change in energy level under analysis is beyond a threshold amount, providing the multiple electrical leads to affix to track leads in a track circuit, where a first set of electrical leads, which are connected to the frequency transmitter, are configured to connect to a first impedance bond located at the insulated rail junction between the two sections of the railroad track, where a second set of electrical leads, which are connected to the receiver, are configured to connect to a second impedance bond located on an opposite side of the insulated rail junction than the first impedance bond, providing the relay output coupled to the energy level detector with one or more output leads that go into one or more inputs of a rail controller to act as a warning that a problem exists with at least one of i) an electrical condition at the impedance bonds themselves as well as ii) an electrical condition of electrical paths between the railroad tracks and the impedance bonds, at a given insulated rail junction, where the relay output is configured to change when the detected change in the energy level under analysis is beyond the threshold amount, and where the rail bond monitor is configured to provide a warning system, through detected change in the energy level, that the problem exists with at least one of i) an electrical condition at the impedance bonds themselves as well as ii) an electrical condition of electrical paths between the railroad tracks and the impedance bonds, at the given insulated rail junction.

12. The method of claim 11, further comprising:

providing two or more tuned filter circuits to isolate at least one of i) electrical signals and ii) electrical shorts coming from the rail bond monitor from electrically interfering with operations of a track circuit implemented by the railroad tracks, where a first tuned filter circuit is electrically coupled to the frequency transmitter, where a second tuned filter circuit is electrically coupled to the receiver.

13. The method of claim 12, where the two or more tuned filter circuits are inductive-capacitance circuits configured to act as a bandpass filter.

14. The method of claim 12, where the frequency transmitter in the overlay track circuit is configured to generate electrical signals in an audio frequency range.

15. The method of claim 11, where the energy level detector coupled to the receiver is configured to detect the energy level change as an impedance change in the impedance bonds themselves and/or in the electrical paths between the railroad tracks and the impedance bonds, at the given insulated rail.

16. The method of claim 11, where the rail bond monitoring system will allow, in conjunction with a broken rail detection system for a set of railroad tracks, will provide end-to-end assurance of a complete electrical return system when a problem exists with an electrical return path for a propulsion system for a train.

17. The method of claim 11, where each of the electrical leads has its own bandpass filter, where the frequency transmitter is configured to generate an audio frequency signal that passes through the bandpass filters onto the railroad tracks and then through a first impedance bond and its associated rail connections, where after passing through the first impedance bond and its associated rail connections, then the audio frequency signal from the transmitter passes through a second impedance bond located on an opposite side of the insulated rail junction than the first impedance bond and then goes into the electrical leads and their associated bandpass filters onto the receiver.

18. The method of claim 11, where the rail bond monitor further contains multiple receivers, where each receiver is configured to connect to its own set of railroad tracks and its own associated impedance bond at the junction of where the insulated sections of the railroad track meet up.

19. The method of claim 11, where the electrical leads are configured to connect directly to the track circuit down to the railroad tracks, via one or more tuned filters, through the impedance bonds, and back through one or more tuned filters to the receiver, where the tuned filters are tuned to pass a frequency wavelength that the transmitter is configured to generate.

20. The method of claim 11, where the rail bond monitor further contains multiple frequency transmitters, where each frequency transmitter is configured to transmit a different frequency than the other transmitters wavelength to multiple receivers, in a railroad track that implements a drain bond, to detect that the problem exists with at least one of i) an electrical condition at the impedance bonds themselves as well as ii) an electrical condition of electrical paths between the railroad tracks and the impedance bonds, at the given insulated rail junction.

* * * * *